US005259277A

United States Patent [19]

Zurbuchen

[11] Patent Number: 5,259,277

[45] Date of Patent: Nov. 9, 1993

[54] ELECTRICALLY INSULATING COMPOSITE HAND TOOL

[75] Inventor: Gregory A. Zurbuchen, Kenosha, Wis.

[73] Assignee: Snap-on Tools Corporation, Kenosha, Wis.

[21] Appl. No.: 912,843

[22] Filed: Jul. 13, 1992

[51] Int. Cl.[5] ..... B25G 1/12

[52] U.S. Cl. ..... 81/177.1; 81/53.1; 81/900

[58] Field of Search ..... 81/900, 177.1, 177.4, 81/125, 489, 490, 53.1

[56] References Cited

U.S. PATENT DOCUMENTS 1,442,181 1/1923 Simon ..... 81/177.4 X
1,510,593 10/1924 Harrold .
1,946,239 2/1934 Ryan .
2,899,996 8/1959 Stockman .
2,917,954 12/1959 Capelle .
3,654,427 4/1972 Schoenwald ..... 228/54 X
3,688,017 8/1972 Roots ..... 81/53.1 X
4,200,126 4/1980 Fish ..... 138/143
4,858,504 8/1989 Tsai .

*Primary Examiner*—D. S. Meislin
*Attorney, Agent, or Firm*—Emrich & Dithmar

[57] ABSTRACT

An insulating hand tool has an elongated composite shank including a pultruded polyester/glass core over-braided with an epoxy/glass outer layer. One end of the shank is received in an axial bore in a plastic handle and the other end thereof is received in one end of a braided glass/epoxy sleeve, which receives in the other end thereof a bit holder which carries a permanent magnet for magnetically retaining an associated working bit. The shank is adhesively secured to the handle and to the sleeve and the sleeve is adhesively secured to the bit holder. The handle may have a bit storage cavity therein closed by a threaded cap.

10 Claims, 1 Drawing Sheet 10
11
13
15
20
21
22
23
24
25
26
27
30
35
36
37
38

ELECTRICALLY INSULATING COMPOSITE HAND TOOL

BACKGROUND OF THE INVENTION

1. Field of the Invention

The present invention relates to hand tools of the type which are relatively non-conducting electrically so that they can be safely used in applications where they may come into contact with sources of electrical power.

2. Description of the Prior Art

Various types of electrically insulated hand tools have been available for many years. Such tools typically have a standard metal shaft/blade which, in addition to being connected to a handle which is formed of electrically insulating material, such as wood or plastic, is also coated or covered with an insulating material. Such insulated tools work acceptably well as long as the insulating covering is intact and in good condition. But, if the insulation becomes damaged, such a tool may be dangerous if it comes in contact with a source of electrical power, the danger being the risk of electrical shock to the user or inadvertent shorting of electrical circuits with which the shank may come in contact. Therefore, such insulated tools are not recommended for use on live electrical wiring, contacts or the like.

Certain types of tools with elongated shanks of plastic material have been provided heretofore, but they have not been hand tools provided with a handle at one end.

SUMMARY OF THE INVENTION

It is a general object of the invention to provide an electrically insulating hand tool which avoids the disadvantages of prior hand tools while affording additional structural and operating advantages.

An important feature of the invention is the provision of an electrically insulating hand tool which is of simple, lightweight and economical construction.

In connection with the foregoing feature, another feature of the invention is the provision of a hand tool of the type set forth, which has a handle and shank with no electrically conducting parts.

In connection with the foregoing feature, another feature of the invention is the provision of a hand tool of the type set forth, which has a shank of a unique, composite, electrically insulating construction.

These and other features of the invention are attained by providing an insulating hand tool comprising: an elongated shank formed of electrically insulating material and having a handle end and a working end, a handle formed of electrically insulating material and connected to the handle end of said shank, and a bit holder connected to said shank at the working end thereof for coupling to an associated working bit.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 2, 3, 4:
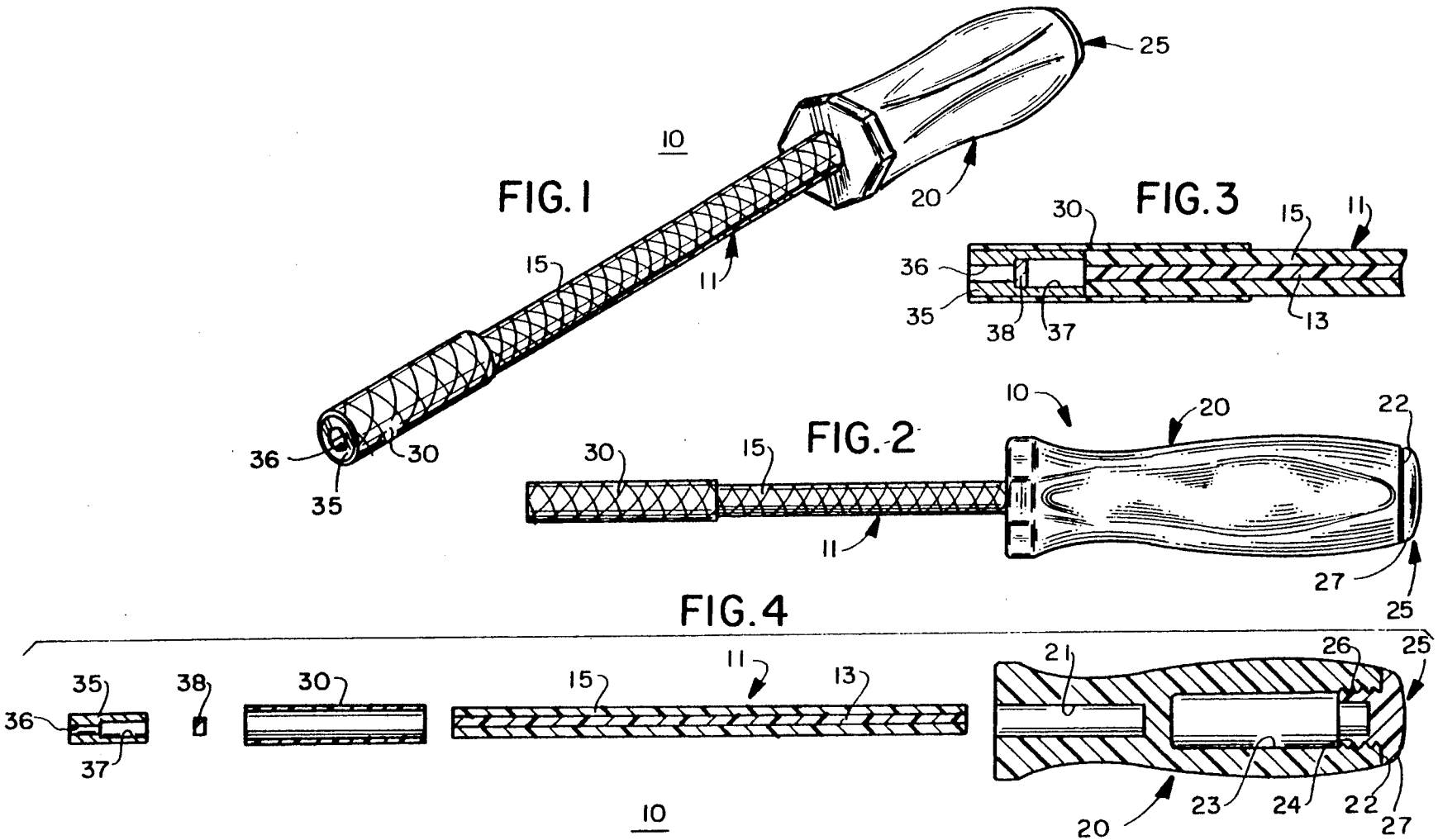
FIG. 1 is a perspective view of a hand tool constructed in accordance with ,and embodying the features of the present invention.
FIG. 2 is a reduced side elevational view of the hand tool of FIG. 1.
FIG. 3 is an enlarged, fragmentary view in vertical section of the working end of the hand tool of FIG. 2.
FIG. 4 is an exploded sectional view of the hand tool of FIG. 2.

There is illustrated in the drawings an electrically insulating hand tool 10 in the form of a screwdriver. While a screwdriver is illustrated, it will be appreciated that the hand tool 10 could be a nut driver or other type of hand tool. The hand tool 10 has an elongated shank 11 of composite construction, including a solid, electrically insulating core 13 formed of pultruded polyester/-glass material, pultrusion being a variation of extrusion in which glass fibers are pulled through a polyester resin bath. An outer layer 15 of a braided glass/epoxy structure is applied over the core 13 along its entire length. The core 13 has high strength in the longitudinal direction but does not have good torsion resistance. The braided outer layer 15 provides high torsional strength to the shank 11.

The hand tool 10 also includes a handle 20 formed of an electrically insulating material, such as a suitable plastic material. The handle 20 has a generally elongated and sculptured shape provided with an axial bore 21 at one end thereof. The other end of the handle 20 has a flat, truncated, end surface 22 having a relatively large-diameter axial bore 23 formed therein and internally threaded at the open end thereof, as at 24. The bore 23 defines a storage cavity or compartment for storing objects, such as working bits for the tool 10. The bore 23 is closed by a plastic cap 25 which has an externally threaded shank 26 adapted for threaded engagement in the bore 23, and an enlarged rounded head 27 shaped to fit flush against the end surface 22 to form a smooth continuation of the outer surface of the handle 20. In assembly, one end of the shank 11 is telescopically received in the bore 21 of the handle 20 and is fixedly secured thereto, as by a suitable adhesive.

The hand tool 10 also includes a cylindrical sleeve 30 formed of an electrically insulating material, such as a braided glass/epoxy which may be the same material as that of which the sleeve 15 is constructed. The sleeve 30 is telescopically received over the distal or working end of the shank 11 and is fixedly secured thereto, as by a suitable adhesive. Received in the other end of the sleeve 30 is a cylindrical bit holder 35, which may be formed of a suitable metal, such as stainless steel. The bit holder 35 has an axial bore 36 therein which preferably has a polygonal transverse cross section at one end thereof, such as a hexagonal cross section, for receiving an associated working bit, such as a screwdriver or blade bit. The bore 36 has an enlarged-diameter counterbore 37 at the other end thereof in which is disposed a cylindrical permanent magnet 38, which may be bonded to the bit holder 35. Preferably, the magnet 38 has a relatively high magnetic strength and may, for example, be a rare earth cobalt magnet.

It will be appreciated that, in use, the magnet 38 magnetically retains an associated working bit in the bore 36 of the bit holder 35. Preferably, the bit holder 35 is completely received telescopically within the sleeve 30, so that no portion thereof projects beyond the sleeve 30, the bit holder 35 being secured in place, as by a suitable adhesive.

It is a fundamental aspect of the present invention that the shank 11 and the handle 20 of the hand tool 10 have no electrically conducting parts. Thus, the hand tool 10 can be safely used with live electrical circuits. While the hand tool 10 has an electrically conductive bit holder 35 at one end thereof, it is completely received within the electrically insulating sleeve 30.

From the foregoing, it can be seen that there has been provided an improved electrically insulating hand tool which is of simple and economical construction and includes a handle and shank with no electrically conducting parts.

I claim:

1. An insulating hand tool comprising: an elongated shank formed of electrically insulating material and having a handle end and a working end, a handle formed of electrically insulating material and connected to the handle end of said shank, a coupling sleeve formed of electrically insulating material and telescopically receiving in one end thereof the working end of said shank and secured thereto, and a bit holder received in the other end of said sleeve and secured thereto.

2. The hand tool of claim 1, wherein said coupling sleeve is formed of an epoxy/glass material.

3. The hand tool of claim 2, wherein said sleeve is of braided construction.

4. The hand tool of claim 1, wherein said sleeve is adhesively secured to said shank and to said bit holder.

5. The hand tool of claim 1, wherein said bit holder is completely received within said coupling sleeve.

6. The hand tool of claim 1, and further comprising a permanent magnet carried by said bit holder for magnetically retaining an associated working bit therein.

7. The hand tool of claim 1, wherein said shank has a composite construction.

8. The hand tool of claim 7, wherein said shank includes a core formed of a polyester/glass material and an outer layer surrounding said core and formed of epoxy/glass material.

9. The hand tool of claim 8, wherein said outer layer is of braided construction.

10. The hand tool of claim 1, wherein said handle is adhesively secured to said shank.

* * * * *